United States Patent [19]

Marbury

[11] Patent Number: 4,930,333

[45] Date of Patent: Jun. 5, 1990

[54] VEHICLE ALIGNMENT APPARATUS

[76] Inventor: Lynwood E. Marbury, 4905 Leisure Dr., Dunwoody, Ga. 30338

[21] Appl. No.: 380,607

[22] Filed: Jul. 17, 1989

[51] Int. Cl.[5] ..... B21D 1/12

[52] U.S. Cl. ..... 72/447; 72/705

[58] Field of Search ..... 72/447, 457, 705

[56] References Cited

U.S. PATENT DOCUMENTS

| | | | |
|---|---|---|---|
| 3,765,764 | 10/1973 | Niss | 356/156 |
| 4,023,394 | 5/1977 | Borup | 72/457 |
| 4,050,287 | 9/1977 | Borup | 72/457 |
| 4,055,061 | 10/1977 | Bayorgeon et al. | 72/705 |
| 4,660,405 | 4/1987 | Widegren et al. | 72/705 |

FOREIGN PATENT DOCUMENTS

| | | | |
|---|---|---|---|
| 2027623 | 2/1980 | United Kingdom | 72/705 |

*Primary Examiner*—Lowell A. Larson

*Attorney, Agent, or Firm*—Thomas & Kennedy

[57] ABSTRACT

A vehicle aligning apparatus has a support platform and means for securing a vehicle thereto. The platform has a transverse front end that is releasibly engageable by a stress bearing plate, a portion of which overlies the platform. An elongated flexible member is affixed at or adjacent one of its ends to the stress bearing plate and its other end is adapted to be fixed to the vehicle. A tensioning ram is mounted at one end to the stress bearing plate and its other end bears against the flexible member at a point intermediate the ends thereof to apply pulling force to the vehicle body or frame.

19 Claims, 3 Drawing Sheets

VEHICLE ALIGNMENT APPARATUS

TECHNICAL FIELD

This invention relates to vehicle alignment apparatus, and, more particularly to an apparatus for aligning damaged vehicle bodies and frames.

BACKGROUND OF THE INVENTION

In the repair and realignment of damaged vehicle bodies or frames, it is common practice to pull the crumpled or damaged body shell, or a bent frame, into a shape or position approximating the original configuration, and finishing repairs then restore the body or frame to the proper condition. In such pulling operation, large forces are generated, and it is essential that the vehicle be firmly anchored to prevent movement or slippage during the pulling operation. As a consequence, prior art arrangements generally comprise a longitudinal frame upon which are mounted and secured thereto transverse beam members which are, in turn, secured to the vehicle body, so that the vehicle body is firmly held against movement in a position above the longitudinal frame with its longitudinal axis parallel to the longitudinal axis of the frame, and with its wheels clear of the frame. Mounted on the frame, either at the front or rear thereof, or at the sides is a pulling apparatus, of which there may be several, which comprises a flexible member, such as a chain, having one end anchored to the frame and the other end hooked or otherwise attached to the portion of the vehicle to be pulled. Tensioning means, such as a hydraulic piston and cylinder ram swivelly mounted at one end to the frame with the other end bearing against the chain intermediate its ends applies tension to the chain, forcing it to pull the damaged portion of the vehicle into shape. As thus far described, such an alignment apparatus is shown and described in U.S. Pat. Nos. 4,023,394 and 4,050,287, both of Borup.

In the just described chain tensioning arrangement it quite commonly occurs that point of anchor of the chain end to the frame, the point of mounting of the ram to the frame, and the point of attachment of the chain to the vehicle are not always longitudinally aligned, nor can they be so aligned. Unless these three points are aligned to be in approximately the same vertical plane, when tension is applied the swivelly mounted piston and cylinder ram tends to tilt or cock. When the points lie in a vertical plane all of the force generated by the ram is directed toward pulling the vehicle body straight along a line lying in the plane. If, however, the ram is tilted, there is a component of force directed transversely to the pulling direction with the consequence that the maximum available pulling force is not utilized, which, in some cases, can result in unsatisfactory or incomplete straightening of the vehicle body or frame.

In the prior art arrangements, the tilting of the ram mechanism is especially common when the apparatus is used to pull the side of the vehicle body or frame, primarily because of a scarcity of places on the apparatus frame at which to mount the ram and to anchor the chain end. In addition, in some instances the point of attachment to the vehicle may be remote from the point of anchoring of the chain, necessitating an unduly long chain.

SUMMARY OF THE INVENTION

The present invention overcomes the problem inherent in the prior art arrangements by insuring that the point of anchor of the chain, the point of mounting of the ram to the frame, and the point of connection of the chain to the vehicle all lie in, or approximately in, the same vertical plane, thereby utilizing the full force generated by the ram to pull the vehicle body or frame in the desired direction, generally parallel to the longitudinal axis of the vehicle or normal thereto.

The invention, in a first illustrative embodiment thereof, comprises a vehicle support platform having front and rear end portions and first and second side portions, and means for securing a vehicle to the platform. An elongated stress bearing plate having platform engaging means at one end thereof for releasibly engaging an end portion of the platform is adapted to overlie a portion of the top of the platform. Means for applying aligning forces to a vehicle body or frame when the vehicle is secured to the platform comprises an elongated flexible member having one end thereof affixed to said platform engaging means and the other end adapted to be secured to the vehicle body portion that is to be pulled. A tensioning means for applying pulling force to the flexible member is mounted to the stress bearing plate and bears against the flexible member intermediate the ends thereof for tensioning the flexible member.

In another embodiment of the invention, wherein the stress bearing plate engages the platform at the front end portion thereof, there are included one or more means for applying aligned forces to the side of the vehicle secured on the platform. Each of the means for applying aligning forces to the sides of the vehicle comprises a stress bearing member having a generally U-shaped configuration adapted to engage the sides of the platform, and elongated flexible means having one end attached to the stress bearing member and the other end adapted to engage the side portion of the vehicle mounted to the platform. Tensioning means mounted to the stress bearing member is adapted to tension the flexible member to cause it to exert a pulling force on the vehicle.

It is a feature of the present invention that each of the front and side mounted stress bearing members are adapted to be moved, prior to the application of pulling forces, to a point on the platform that is such that the point of connection of the flexible tensioning member to the stress bearing member, the point of connection of the flexible member to the vehicle, and the point of application of tensioning forces to the flexible member all lie in approximately the same vertical plane, thereby substantially eliminating any tendency of the tensioning ram to cock or tilt during operation, thereby insuring that the forces are maximally utilized to pull the vehicle body or frame.

This and other features of the present invention will be more readily apparent from the following detailed description, read in conjunction with the accompanying drawings.

DETAILED DESCRIPTION

Figure 1:
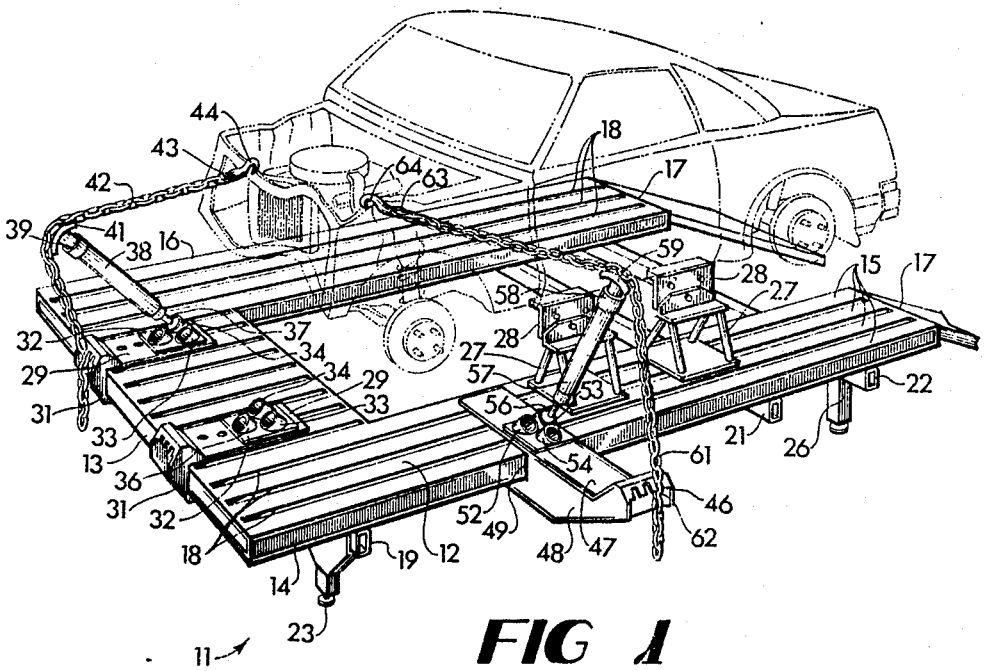
FIG. 1 is a perspective view of a collision repair system embodying the principles of the present invention.
Figure 2:
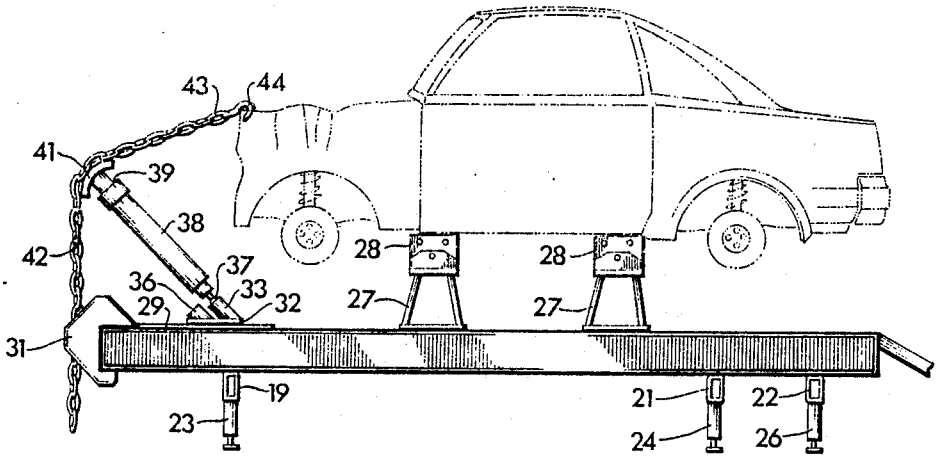
FIG. 2 is a side elevation view of the apparatus of FIG. 1.

Referring to FIGS. 1 and 2, there is shown a vehicle alignment apparatus 11 which comprises a vehicle support platform 12 having a front end portion 13, side portions 14 and 16, and a rear end portions 17,17. A plurality of parallel slots 18,18 extend longitudinally of the platform 12 for supplying mounting access for various accessories, including components of the apparatus of the present invention. Platform 12 may be formed of a plurality of spaced parallel beams 15,15, the spaces between the beams forming slots 18,18. Front end portion 13 extends transversely of the platform, the beams 15,15, and slots 18,18 from side 14 to side 16, thereby forming a solid front end for platform 12. A plurality of transverse support members 19,21, and 22 support platform 12, in an elevated position by means of support jacks 23,24 and 26. It is to be understood that other support means for platform 12 could be used, such as a pneumatic or hydraulic lift, casters, or a wheeled cradle, for example, and the arrangement shown here is for purposes of illustration only. Mounted on platform 12 is a plurality of support stands 27,27, only two of which are visible in FIGS. 1 and 2, at the top of which are vehicle clamping members 28,28 in the form of clamping jaw, for example, which clamp the vehicle, shown in dashed outline, securely in place on stands 27,27. Stands 27,27 may be affixed to the platform 12 in any suitable manner, such as by bolts, not shown, extending through slots 18,18 and snugged tight by means of nuts, now shown, on the underside of platform 12. With this arrangement, the vehicle is firmly suspended above platform 12, as best seen in FIG. 2, with its wheels preferably, although not necessarily, clear of the platform. The jaws 28,28 clamp against the underside of the vehicle, such as along the door sill or rocker panel, and it is held firmly against the pulling forces to be applied to it.

The pulling mechanisms for pulling portions of the damaged vehicle into the desired position comprises a stress bearing plate 29, two of which are shown in FIG. 1, which has affixed at one end thereof a heavy C-shaped platform engaging means 31. When the engaging means 31 engages the front end portion 13 of platform 12, plate 29 overlies and rests upon the top of platform 12, as shown in FIGS. 1 and 2. It can be seen that with this configuration of the C-shaped member 31 and plate 29, stress bearing plate 29 may be located laterally in any desired location along the transverse front end portion 13, and/or on the rear portions 17,17 if desired, as the ramps shown in FIGS. 1 and 2 are detachable. When so located, the C-shaped configuration of member 31 renders the entire stress bearing member readily releasible from the platform. Mounted on stress bearing plate 29 in a manner which will be discussed more fully hereinafter, is a socket bearing base plate 32, having a plurality of angled sockets 33, 34 and 36 mounted thereon for receiving one end 37 of a ram assembly 38, shown in FIG. 1 as a hydraulic cylinder and piston. The other end 39 of the assembly 38 has mounted thereon a shaped bearing member 41 which bears against an elongated flexible member 42, shown in FIGS. 1 and 2 as a chain, which is affixed at one end to member 31, and has a free end 43 adapted to be secured to the vehicle as by a hook 44. It is to be understood that member 42 may take a form other than the depicted chain, however, a chain has the requisite strength and flexibility, and is the preferred apparatus in the prior art.

In operation, with end 43 and hook 44 chain 42 is secured to the vehicle, ram 38 is actuated from a suitable hydraulic source, not shown, and made to increase in length, thereby applying a tensioning force to chain 42 through member 41, and pulling that portion of the vehicle to which the end 43 of chain 42 is secured. As was pointed out hereinbefore, stress bearing plate 29 has been positioned so that the end of chain 42 secured to member 31, the end 37 of ram assembly 38, and the end 43 of chain 42, all lie within substantially the same vertical plane, parallel to the longitudinal axis of platform 12, so that there is substantially no diminution of tension on chain 42 resulting from the cocking or tilting of assembly 38.

As thus far described, the apparatus 11 of the invention is adapted to apply a pulling force to the vehicle along an axis parallel to the longitudinal axis of platform 12. As is quite often the case, the vehicle may be damaged on the side thereof as well as, or instead of, the front, and it becomes necessary to apply lateral pulling forces to the vehicle body or frame, that is, forces substantially normal to the longitudinal axis of platform 12. To this end, the apparatus 11 of FIG. 1 includes a second pulling mechanism comprising an elongated stress bearing member 46 having an upper portion 47 and a lower portion 48 which define a U-shaped slot 49 dimensioned to embrace the side portion 14 of platform 12, with upper portion 47 overlying and resting on the top surface of platform 12. As is the case with stress bearing member 29 and platform engaging means 31, member 46 releasibly engages the side of platform 12 and may readily be moved therealong for precise positioning, as explained in connection with stress bearing plate 29 and engaging means 31.

A socket bearing base plate 51 is mounted on top of upper portion 47 and has mounted thereon a plurality of angled sockets 52,53 and 54 adapted to receive one end 56 of a ram assembly 57. The other end 58 of ram assembly 57 has mounted thereon a shaped bearing member 59 which engages an elongated flexible member 61, e.g. a chain. One end 62 of flexible member 61 is affixed to member 46 in a manner which will be explained more fully hereinafter, and the other end 63 is adapted to be secured to the vehicle as by a hook 64.

The operation is the same as explained in the foregoing in connection with pulling forces directed parallel to the longitudinal axis of platform 12 and hence of the vehicle, except the forces are now directed along directions normal to the longitudinal axis of platform 12.

It can readily be appreciated that the plurality of angled sockets 33,34 and 36 permit a precise positioning of the end 37 of ram 38, as do the sockets 52,53 and 54 for end 56 of ram 57. In addition, multiple sockets make it possible to use two or even three rams with corresponding flexible members to produce an increased pulling effort. It can also be seen that a plurality of stress bearing plates 29 and/or stress bearing members 46 can be used where it is desired to make multiple pulls simultaneously, with each plate 29 or member 46 being positioned for maximum effectiveness.

Figure 3:
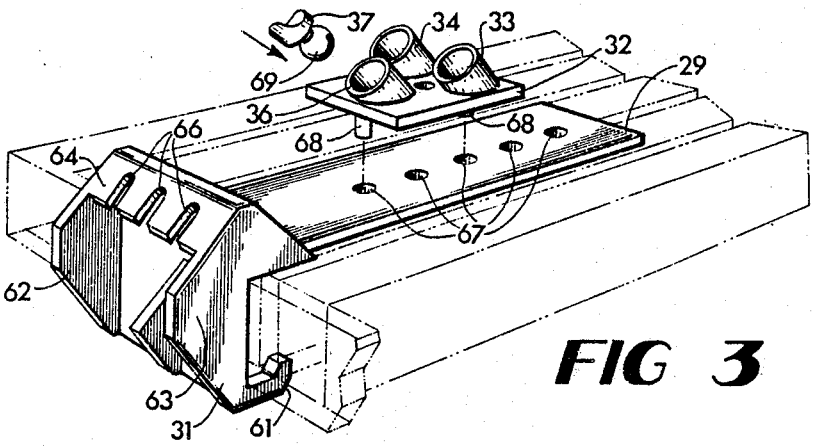
FIG. 3 is a perspective view of the forward stress bearing member and engaging means and stress plate of the invention.
Figure 4:
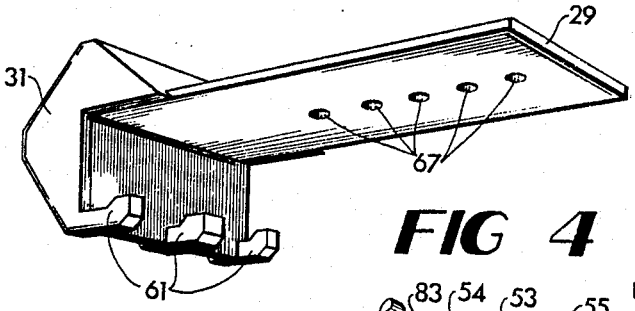
FIG. 4 is a different perspective view of the engaging means and plate of FIG. 3.

FIGS. 3 and 4 depict in detail the structure of stress bearing plate 29 and platform engaging means 31. It can be seen that C-shaped means 31 has a plurality of spaced tangs 61 at the bottom thereof which project toward platform 12 when means 31 is mounted thereto, and which have upwardly projecting ends. The spacing of tangs 61 is the same as the spacing of slots 18 so that, when member 31 is mounted on platform 12, the upwardly projecting ends of the tans 61 extend into slots 18, thereby effectively securing member 31 and plate 29 from shifting laterally when mounted to platform 12.

At the top rear of platform engaging means 31 is a pair of flanges 62 and 63, having a plate 64 extending therebetween. Plate 64 has a plurality of downwardly facing slots 66,66 which are sufficiently wide to receive the thickness of a chain link, but not to receive the width of such a link. Thus slots 66,66 function as anchors or securing means for the chain when a link thereof is slipped into slot, inasmuch as the next link is oriented so that its width prevents it from passing through the slot as seen, for example, in FIG. 7. Plate 64, flanges 62 and 63, and means 31 are preferably a unitary structure, as shown, although another construction can be used provided it is sufficiently strong to withstand the large pulling forces on the chain during operation.

Plate 29 has a plurality of aligned holes 67,67 therein which are positioned to lie over a slot 18 when the ends of tangs 61,61 lie within slots 18,18, as described hereinbefore. Socket bearing base plates 32 has a pair of downwardly depending dowels or pins 68,68 which are spaced to fit into two holes 67,67 and to extend down into a slot 18 when plate 29 is mounted in position. Such an arrangement permits some latitude in the longitudinal positioning of sockets 33,34, and 36. The end 37 of ram assembly 38 terminates in a ball 69 which is adapted to fit into and swivel in one of the sockets 33,34, and 36. The use of three such sockets permits optimum location of ram assembly 38 on stress bearing plate 29, and also allows for the simultaneous use of more than one ram assembly.

In operation, the configuration of member 31, plate 29, plate 32, and sockets 33,34 and 36 is such that the forces are toward the rear of platform 12, thereby insuring firm anchorage of member 31 and plate 29.

Figure 5:
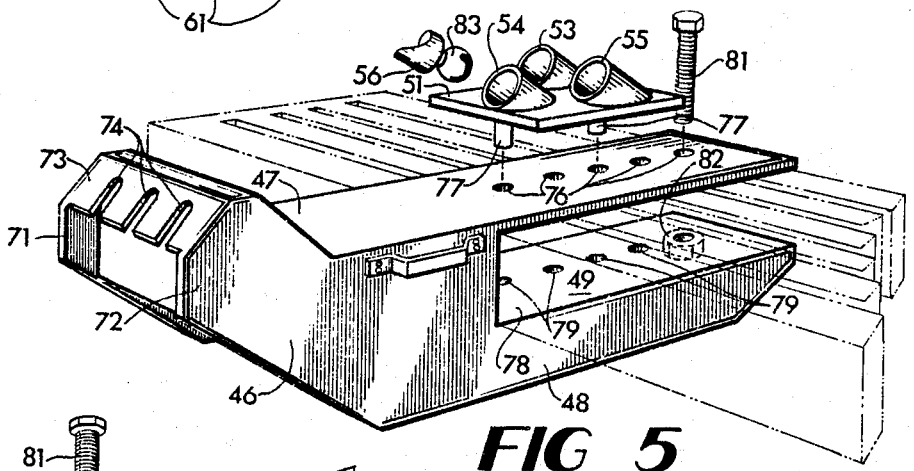
FIG. 5 is a perspective view of the side stress bearing member of the arrangement of FIG. 1.
Figure 6:
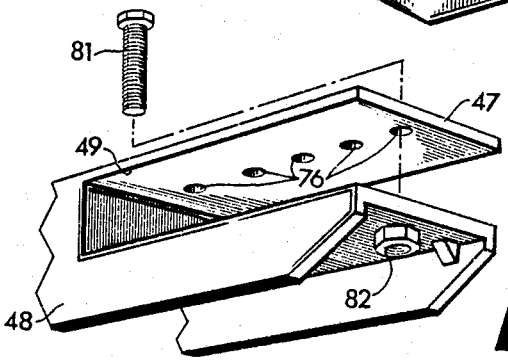
FIG. 6 is a different perspective view of the member of FIG. 5.

FIGS. 5 and 6 depict, in detail, stress bearing member 46 for use in applying pulling forces to the sides of the vehicle. It can be seen that upper portion or plate 47 and lower portion 48 define a U-shaped slot 49 dimensioned to embrace a side portion of platform 12, with plate 47 lying atop the top of platform 12, and portion 48 underlying platform 12. The top rear portion of member 46 has a pair of flanges 71 and 72 with a plate 73 extending therebetween. Plate 73 has a plurality of slots 74 for anchoring one end, or a portion, of the chain 61, in the same manner as discussed in connection with FIGS. 3 and 4.

Member 47 has a plurality of spaced holes 76,76, the spacing of which is the same as the spacing of slots 18, and which are adapted to receive dowels or pins 77 depending from the underside of socket bearing base plate 51. Member 48 has an upper plate 78 having a plurality of holes 79 therein, spaced the same as holes 76 and directly underlying them so that member 46 may be affixed to platform 12 by means of, for example, a bolt 81 which extends through holes 76 and 79, a slot 18, and is affixed by a nut 82 bearing on the bottom surface of portion 48, as seen in FIG. 6.

End 56 of ram assembly 57 terminates in a ball 83 which fits into, and swivels in one of the sockets 52,53, or 54, in the same manner as was discussed in connection with FIGS. 3 and 4. The operation and advantages of the arrangement of FIGS. 5 and 6 are the same as discussed in connection with FIGS. 3 and 4, with the configuration permitting locating member 46, and hence the pulling mechanism, directly opposite virtually any point on the vehicle side.

Figure 7:
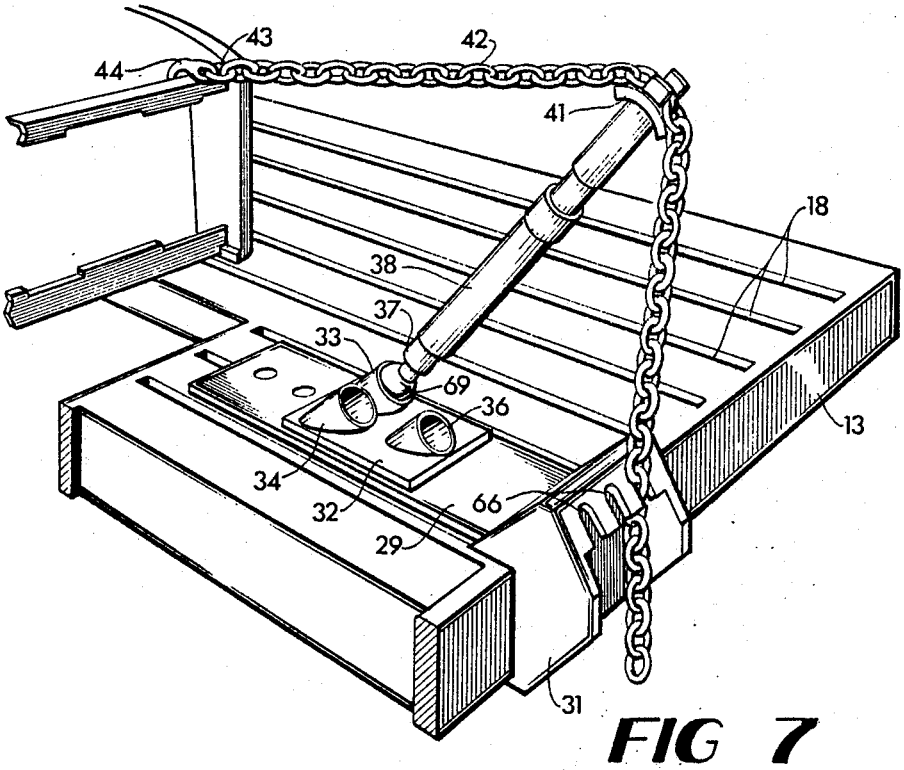
FIG. 7 is a perspective view of the details of the front tensioning means of FIG. 1.

FIG. 7 depicts the pulling mechanism for the front (or rear) end of the vehicle as it appears in operation, the details of which have previously been discussed.

Figure 8:
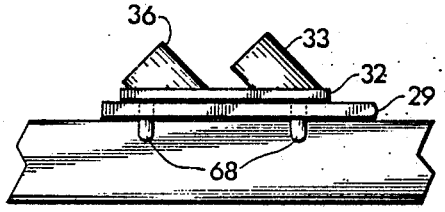
FIG. 8 is a side elevation view of a detail of the arrangement of FIG. 7.
Figure 9:
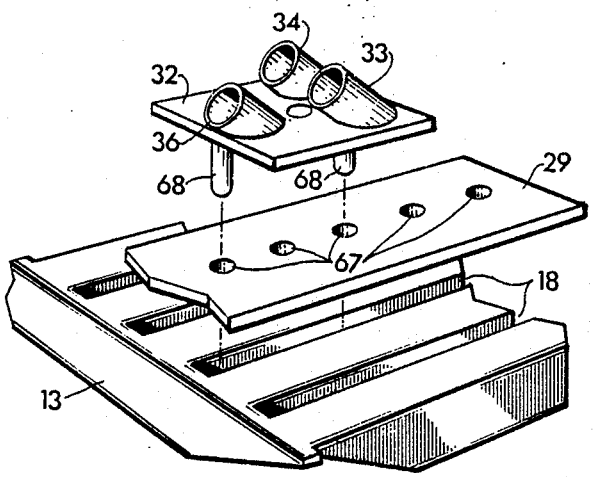
FIG. 9 is an exploded perspective view of the detail of FIG. 8.

FIGS. 8 and 9 depict the socket bearing plate 32 in position on plate 29 and illustrates how the pins or dowels 68 extend down into slots 18.

From the foregoing it can readily be seen that the structure of the illustrated embodiment of the invention permits an almost unlimited range of positions of the pulling mechanism so that it may, in each instance, be optimally located for most efficient use of the apparatus.

The foregoing has been for purposes of illustrating the principles of the present invention in an illustrative embodiment thereof. Numerous changes or modifications may occur to workers in the art without departure from the spirit and scope of the invention.

I claim:

1. An apparatus for realigning damaged vehicle bodies with said apparatus comprising:

a vehicle support platform having a front end portion, a rear end portion and side portions;

means for securing a damaged vehicle on said platform;

an elongated stress bearing plate having first and second ends;

platform engaging means at said first end of said stress bearing plate for releasibly engaging an end portion of said platform with said plate positioned to overlie a portion of said platform; and means for applying aligning force to a vehicle secured to said platform including an elongated flexible member secured at one end to said platform engaging means and adapted to be secured at its other end to a selected portion of the vehicle, and tensioning means mounted on said plate for applying tension to said flexible member intermediate the ends thereof, whereby force is applied to the vehicle upon activation of said tensioning means causing the vehicle body to be pulled into realignment.

2. The apparatus of claim 1 wherein said platform is formed by a plurality of spaced parallel beams.

3. The apparatus of claim 2 wherein said platform has side portions positioned to underlie the wheels of a vehicle secured on said platform and a front end portion positioned to extend forwardly of a vehicle secured on said platform.

4. The apparatus of claim 3 wherein said spaced parallel beams are joined at said platform front end portion by an end plate secured along its length to an end of each of said parallel beams.

5. The apparatus of claim 4 wherein said platform engaging means is generally C-shaped and sized to embrace said platform at the front end thereof with said load bearing plate extending toward the position of a vehicle secured on said platform.

6. The apparatus of claim 5 wherein a portion of the lower arm of said C-shaped platform engaging means is configured to extend upwardly into the space between adjacent parallel beams of said platform to secure said engaging means laterally on said platform.

7. The apparatus of claim 1 further comprising a base plate adjustably mountable on said stress bearing plate and adapted to receive said tensioning means.

8. The apparatus of claim 7 wherein said stress bearing plate has a set of holes formed therein and wherein said base plate includes at least one depending dowel adapted to extend through a selected hole in said stress bearing plate whereby the base plate can be removably secured on the stress bearing plate at a selected position with the dowel extending through a corresponding hole in the stress bearing plate.

9. The apparatus of claim 8 wherein said platform is formed by a plurality of spaced parallel beams and wherein the set of holes in said stress bearing plate are positioned to align with the space between adjacent beams when said platform engaging means is mounted to said platform.

10. The apparatus of claim 9 wherein said dowel is sized to extend through a selected hole in said stress bearing plate and into the corresponding space between adjacent spaced beams.

11. The apparatus of claim 7 wherein said tensioning means comprises an extendable hydraulic ram having a first end portion adapted to be received by said base plate and a second end portion adapted to engage said elongated flexible member intermediate its ends.

12. The apparatus of claim 11 wherein said ram first end portion includes a ball and said base plate includes at least one socket configured to receive said ball for swiveling movement of said ram.

13. The apparatus of claim 1 wherein said platform is elongated having side portions and a front end portion and wherein said platform engaging means is adapted to engage the front end portion of the platform for application of aligning force to the front of a damaged vehicle secured on said platform and wherein said apparatus further comprises means for applying aligning force to the side of a vehicle secured on said platform with said means including an elongated flexible member adapted to be secured to the side of a vehicle at one end, an elongated stress bearing member having upper and lower portions defining a U-shaped slot at one end of said stress bearing member for embracing a side portion of said platform with said upper portion including a flat plate configured to overlie a portion of said platform when the stress bearing member is mounted thereto, the other end of said stress bearing member extending outwardly from said platform and being adapted to secure the other end of said elongated flexible member, and tensioning means mounted to said flat plate of said stress bearing member for applying tension to said flexible member intermediate the ends thereof.

14. The apparatus of claim 13 and further comprising a base plate adapted to be adjustably mounted on said flat plate with said base plate being adapted to receive said tensioning means.

15. The apparatus of claim 14 wherein said tensioning means comprises an extendable hydraulic ram and said elongated flexible member comprises a chain and wherein one end of said ram is formed to define a generally spherical ball and the other end of said ram is configured to engage said chain, said base plate including at least one socket configured to receive said ball for swiveling movement of said ram.

16. In a damaged vehicle realigning apparatus of the type having a vehicle support platform defined by a plurality of spaced parallel beams and means for securing a vehicle upon the platform, the improvement comprising means for applying aligning force to a vehicle secured on said platform with said means including a stress bearing plate at one end of which is formed a platform engaging means configured to be mounted to an edge of the platform with said plate overlying a portion of the platform, a chain releasibly secured at one end to said platform engaging means and securable at its other end to a vehicle mounted on said platform and tensioning means on said stress bearing plate for applying tension to said chain intermediate its ends.

17. The improvement of claim 16 wherein said tensioning means is an extendable hydraulic ram and further comprising a base plate adjustably and removably mountable on said stress bearing plate and adapted to receive one end of said ram, the other end of said ram being adapted to engage said chain intermediate its ends.

18. The improvement of claim 17 wherein said stress bearing plate has a set of holes formed therein with said holes being positioned to align with the space between adjacent beams of the platform when said platform engaging means is mounted thereto, said base plate including a pair of depending dowels adapted to extend through a selected pair of holes in said stress bearing plate and into the space between two adjacent beams.

19. The improvement of claim 18 wherein said one end of said ram is formed to define a generally spherical ball and wherein aid base plate includes at least one socket configured to receive said ball for swiveling movement of said ram.

* * * * *